US005280669A

United States Patent [19]

Nanbu et al.

[11] Patent Number: 5,280,669

[45] Date of Patent: Jan. 25, 1994

[54] BUCKLE UNIT

[75] Inventors: Yuichi Nanbu; Hiromu Usuda; Katsumi Inoue, all of Shiga, Japan

[73] Assignee: Takata Corporation, Tokyo, Japan

[21] Appl. No.: 970,526

[22] Filed: Nov. 2, 1992

Related U.S. Application Data

[63] Continuation of Ser. No. 674,270, Mar. 25, 1991, abandoned.

[30] Foreign Application Priority Data

Mar. 26, 1990 [JP] Japan ..... 2-77515
May 8, 1990 [JP] Japan ..... 2-117899

[51] Int. Cl.[5] ..... A44B 11/26
[52] U.S. Cl. ..... 24/641; 24/633
[58] Field of Search ..... 24/633, 636, 637, 640, 24/641, 645, 651; 297/468

[56] References Cited

U.S. PATENT DOCUMENTS 5,008,989 4/1991 Wedler et al. ..... 24/633 X
5,029,369 7/1991 Oberhardt et al. ..... 24/633

FOREIGN PATENT DOCUMENTS 0114332 8/1984 European Pat. Off. .
0212507 3/1987 European Pat. Off. .
3533684 2/1987 Fed. Rep. of Germany ..... 24/633
WO83/03741 11/1983 PCT Int'l Appl. ..... 24/633
2104141A 3/1983 United Kingdom .
2195140A 3/1988 United Kingdom .
2223265A 4/1990 United Kingdom .

*Primary Examiner*—James R. Brittain
*Attorney, Agent, or Firm*—Armstrong, Westerman Hattori, McLeland & Naughton

[57] ABSTRACT

When the connection of the buckle main body A with the tongue is to be released during normal operation, the operating member is operated and is moved to the position where the engagement of the tongue with the latch member can be released. In this case, the locking member can be moved toward the position where the engagement of the tongue with the latch member can be released, and the locking member is perfectly moved to the position where the engagement of the tongue with the latch member can be released by the operating member. When impact is applied on the buckle unit, control device prevents the locking member from moving toward the position where the engagement of the tongue with the latch member can be released. For this reason, the engagement of the tongue with the latch member cannot be released, and the connection of the buckle main body with the tongue can be maintained.

3 Claims, 11 Drawing Sheets

BUCKLE UNIT

This application is a continuation of application Ser. No. 07/674,270 filed Mar. 25, 1991, abandoned.

BACKGROUND OF THE INVENTION

The present invention relates to a buckle unit for seat belt to be provided on a seat in an automobile or other vehicle.

As present, seat belt is furnished on the seat of automobile and other vehicle for the purpose of protecting occupants of the vehicle from collision. To facilitate the procedure to remove or put on seat belt of this type, a buckle unit is usually provided, which generally comprises a latch member with a claw to engage with a tongue, and the latch member is pushed by a spring toward the direction to engage with the claw.

In such case, if resilient force of spring against the latch member is decreased in order to reduce the operating force at the release, the engaging force between the tongue and the latch member becomes weaker. When heavy crash such as vehicle collision occurs, the latch member is displaced by inertia, and the tongue is withdrawn from the buckle, i.e. the so-called inertial withdrawal is very likely to occur. To cope with this problem, spring force to the latch member had to be increased in order to prevent such inertial withdrawal. This leads to the undesirable increase of operating force necessary for the release of the engagement of the above buckle, and there have been strong demands on the alleviation of the operating force.

To solve such problem, it has been proposed to offer such buckle unit that a locking member is slidably mounted to hinder the displacement during the engagement of the tongue with the latch member on the buckle side so that the latch member is not moved toward the direction to unexpectedly separate from tongue by inertia force caused by heavy crash. Such units are disclosed in the Japanese Utility Model Publication No. 64-87, the Japanese Provisional Utility Model Publication No. 63-88108, the Japanese Provisional Utility Model Publication No. 60-139560, etc.

As an example, the buckle unit of the Japanese Provisional Utility Model Publication No. 60-139560 is shown in FIG. 15 and FIG. 16.

In these figures, 1 represents a tongue, which has a belt connecting hole 2 on one end and an engagement hole 3 on the other end. On the other hand, 4 is a frame of the buckle main body A, in or from which the above tongue 1 is inserted or detached. The buckle main body A is assembled on said frame 4 as its base.

The above buckle main body A comprises said frame 4, the latch member 5 to be connected with said frame 4 as base, a locking member 6 to control the movement of said latch member 5, an operating member 7 moving slidably, an ejector 9 to eject the released tongue 1 from the frame 4 by spring 8, and a cover member 10 to cover the buckle element, which comprises the above members and components.

The frame 4 is formed in U-shape, comprising a bottom plate **4*a* and lateral walls 4*b* and 4*c* running upward from both sides of the bottom plate 4*a*. On the lateral walls 4*b* and 4*c*, the following members and components are sequentially provided from the portion where the tongue 1 is inserted toward the depth: fan-shaped windows 12 and 12', into which the extended portions 11 and 11' extending in transverse direction from both sides of the latch member 5 are to be inserted, and fulcrum holes 14 and 14', into which the support shafts 13 and 13' protruding on the sides of the latch member 5 are supported. Further, on upper backward portion of lateral walls 4*b* and 4*c*, notches 17 and 17' are provided, where spring support plate 16 is supported in cooperation with the open hole 15 on the bottom plate 4*a***.

On the fan-shaped windows 12 and 12', projections 19 and 19' are furnished, which can be engaged in the open holes 18 and 18' on the extended portions 11 and 11' downward from above. The end surfaces **12*a* and 12*a'* of the fan-shaped windows 12 and 12' where the tongue 1 is inserted are placed face-to-face to the shoulders 11*a* and 11*a'* of the extended portions 11 and 11' of the latch member 5 with a slight gap between them so that, when the vehicle is collided, the tensile load applied on the latch member 5 is directly transmitted to the frame 4**.

At the center of the frame bottom plate **4*a*, an opening is formed continuously with the open hole 15 for movably guiding the ejector 9 by both edges along the direction to insert or remove the tongue 1. On the front end of the opening 20, a guide rod 20*a* to be inserted into the guide hole 9*a* of the ejector 9 is protruding from the direction of the insertion of the tongue 1. On the spring support plate 16 placed face-to-face to this guide rod 20*a*, a spring receptacle 21 to support the fixed end of the spring 8, which pushes the ejector 9, is furnished. Further, a belt connecting hole 22 is furnished on the bottom plate 4*a* behind the open hole 15**.

The latch member 5 is bent in L-shape on the axial line of the support shafts 13 and 13'. At lower center of the latch portion **5*a* in parallel to the frame bottom plate 4*a*, a claw 23 to be connected to the engagement hole 3 of the tongue 1 is provided. Between the back plane of the lever unit 5*b*, vertically rising from the support shafts 13 and 13' and the spring support plate 16, latch portion 5*a* is pushed at all times toward the direction "X" (shown by an arrow in FIG. 16) by resilient force of compression spring 24 toward the direction approaching the frame bottom plate 4*a* around the support shafts 13 and 13'**.

The locking member 6 is integrally provided with two movement stoppers 25 and 25' in such size as to close the open holes 18 and 18' of the latch member 5 on both sides, and these are slidably mounted on upper surface of the latch portion **5*a* of the latch member 5 with the predetermined stroke along the inserting or removing direction of the tongue 1. By a tension spring 28, furnished between the hook 26 formed by bending upward from the center of the locking member 6 and the hook 27 formed on front end of the latch member 5, the locking member 6 is pushed permanently toward the direction to detach the tongue against the latch member 5, i.e. in the direction "u" (as shown by an arrow in FIG. 16**.).

On the other hand, the front end surface of the operating member 7 is a pressure surface **7*a* capable to perform pressing movement, and the rear end surface is a lever touching surface 7*b* to touch the front surface of the lever portion 5*b* of the latch member 5. Further, the vertical surface is a touching surface 7*c* to touch the touching part 29 of the locking member 6. The operating member 7 is guided by two guide rods 30 and 30', which are horizontally protruding from spring support plate 16 and is slidably movable in the inserting or removing direction of the tongue 1. Further, the operating member 7 is pushed permanently in the direction "u" by two springs 31 and 31', which are engaged on outer periphery of the guide rods 30 and 30' on the spring support plate 16**.

The positional relationship between the lever touching surface 7b and the locking member touching surface 7c is such that, during the pressing operation, the locking member touching surface 7c comes into touch with the locking member 6 at first and the locking member 6 is slided toward the direction "v" (shown by an arrow in FIG. 16). When the movement stoppers 25 and 25' of the locking member 6 release the open holes 18 and 18' of the latch member 5, the lever touching surface 7b comes into touch with the lever portion 5b of the latch member 5 to start to tilt the latch member 5.

The marginal portions of the pressing surface 7a of the operating member 7 are surrounded by the cover member 10 in almost the same plane, and this prevents unexpected release of the buckle engagement when elbow of the passenger touches the operating member 7.

Further, the ejector 9 mounted on the frame bottom plate 4a is designed in such manner that it can be displaced within the predetermined sliding range by the insertion or removal of the tongue 1. The sliding range of its front end is set in such manner that the rotating of the latch member 5 toward the direction to engage with the tongue 1 is hindered, and that at least a part of it lies between the claw 23 of the latch member 5 and the frame bottom plate 4a at the end of the pushing movement of the tongue 1.

The front end on the top of the latch member 5 is provided with a pair of projections 32 and 32', by which the forward movement of the locking member 6 is limited.

The spring guide rod 33 protruding from spring support plate 16 has oblong and flat tip, from which a slit 34 is formed along the center. On outer surface of the tip, fall-stop projections 35 and 35 are furnished to engage with the free end 24a of compression coil spring 24, and the tip of the guide rod 33 is inserted into the oblong notched portion 36 provided on the lever 5a of the latch member 5.

On the other hand, the ejector 9 has a hole 39 at the end surface to receive one end of the spring 8. Near the opening of this hole 39, a pin hole 38 is provided, into which the pin 37 is inserted into the direction perpendicular to the hole 39. Spring 8 is compressed and is accommodated in the hole 39, and the pin 37 passing through the pin hole 38 is used to receive and hold the compressed spring 8. After the fixed end of the spring 8 is brought into contact with the tip of the spring receptacle 21 of the spring support plate 16, the pin 37 is removed, and spring 8 is stretched. Thus, the fixed end of the spring 8 is engaged in the spring receptacle 21.

In the buckle unit with such arrangement, when the tongue 1 is inserted into the buckle main body A in the arrow direction "w" with the tongue in the preparation status shown in FIG. 16, the ejector 9 is pushed by the tip of the tongue 1, is moved backward, and is retreated from lower portion of the claw 23 of the latch member 5. The latch member 5 is rotated in the direction of the arrow "X" around the support shafts 13 and 13' by the action of compression coil spring 24, and the claw 23 is engaged with the engagement hole 3 of the tongue 1. As the result, the tongue 1 is engaged with and connected to the buckle main body A.

In this case, the movement stoppers 25 and 25' of the locking member 6 are separated from the backside of the projections 19 and 19' as the latch member 5 is rotated and displaced, and they are further moved in the direction of the arrow "u" by the action of the tension spring 28. Because the movement stoppers 25 and 25' close the open holes 18 and 18' of the latch member 5, the projections 19 and 19' are hindered from entering into these open holes 18 and 18'. Therefore, in case abnormal impact is applied such as the vehicle collision, the rotating of the latch member 5 in the direction of the arrow "Y" is restricted because the top surfaces of the movement stoppers 25 and 25' are in touch with the lower ends of the projections 19 and 19', and the latch member 5 is held at the lower position. As the result, the separation of the tongue 1 from the buckle main body A is prevented.

Next, in case the tongue 1 is separated from the buckle main body A, the pressing surface 7a of the operating member 7 is pressed by finger in the direction of the arrow "v." Then, the locking member touching surface 7c of the operating member 7 is engaged with the touching portion 29 of the locking member 6, and the locking member 6 is displaced in the direction of the arrow "v" against the resilient force of the tension spring 28. For this reason, the stoppers 25 and 25' move from above the open holes 18 and 18' of the latch member 5, allowing the projections 19 and 19' to enter the open holes 18 and 18'. Then, the lever touching surface 7b pushes the lever member 5b of the latch member 5, and is rotated in the direction of the arrow "Y" against the resilient force of compression coil spring 24. Therefore, the latch member 5 is separated from the buckle main body A as the tongue 1 is pushed by the ejector 9 as soon as the claw 23 is moved upward and is withdrawn from the engagement hole 3 of the tongue 1. The latch member 5 is held at the saving position above until the ejector 9 touches the lower surface of the claw 23 of the latch member 5 and the tongue 1 is inserted. When the pushing force on the operating member 7 is cancelled, the operating member 7 is moved in the direction of the arrow "u" by the force of the springs 31 and 31' and returns to the initial position as shown in FIG. 16.

In this way, the tongue 1 can be easily engaged with or separated from the buckle main body A.

Incidentally, the direction of the impact force caused by collision differs according to the conditions of each collision, and the impact force may act in the direction to insert the tongue into the buckle. Thus, it is necessary to take proper measures against the impact force working toward the direction to insert the tongue. For this purpose, the force of the springs 31 and 31' to push the operating member 7 and the force of the tension spring 28 to push the locking member 6 are increased. As the result, even when impact force works in the direction to insert the tongue, the operating member 7 and the locking member 6 are not moved by inertia because the force of springs 31 and 31' as well as that of the tension spring 28 are strong enough. Accordingly, the tongue is not withdrawn from the buckle, i.e. so-called inertial withdrawal is prevented.

However, the increase of the spring force of the tension spring 28 and springs 31 and 31' results in heavier operating touch and in poor improvement of operating feeling as in the cases of the buckles of the conventional type. Because strong resilient force is required, although not so strong as in the case of the conventional type buckle, the problem also arises with higher cost of tension spring 28 and the springs 31 and 31'.

SUMMARY OF THE INVENTION

The object of the present invention is to offer a buckle unit, by which it is possible to prevent the inertial withdrawal by properly matching the impact from all directions, to provide good operating feeling, and to reduce the cost.

To attain such object, the buckle unit according to the present invention comprises a buckle main body, a tongue to be inserted and engaged with the buckle main body, a latch member for engaging with said tongue and for connecting said tongue with said buckle main unit when the tongue is inserted into said buckle main body, an operating member for releasing the engagement of said tongue with said latch member, and a locking member for holding said latch member at said engaged position and being moved by said operating member to the position where the engagement of said latch member with said tongue can be released, and it is characterized in that control means is provided so that said locking member can be moved to the position where the engagement of said latch member with said tongue can be released when said operating member is normally operated, and that the movement of said locking member is hindered from moving to the position where the engagement of said latch member with said tongue can be released when impact is applied.

In the buckle unit according to the present invention with such arrangement, when the connection of buckle main body with the tongue is released in normal case, the locking member is moved to the position where the engagement of the latch member with the tongue can be released by operating the operating member. In this case, the locking member can be moved to the position where the engagement of the latch member with the tongue can be released. Accordingly, by means of the operating member, the locking member can be moved to the position where the engagement of the latch member with the tongue can be released.

When impact is applied on the buckle unit, the control means hinders the locking member from moving to the position where the engagement of the latch member with the tongue can be released. For this reason, the engagement of the tongue with the latch member is not released, and the connection of the buckle main body with the tongue can be positively maintained.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF OF THE DRAWINGS

Figure 1A:
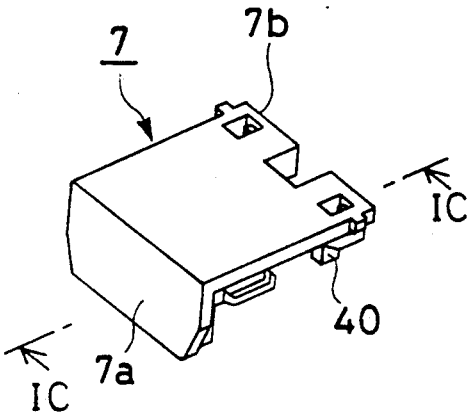
FIG. 1 shows a part of an embodiment of the buckle unit according to the present invention, where (a) is a perspective view of an operating member, (b) a perspective view of latch member, (c) is a cross-sectional view along the line IC—IC in (a), and (d) is a cross-s view along the line ID—ID in (b)
Figure 1B:
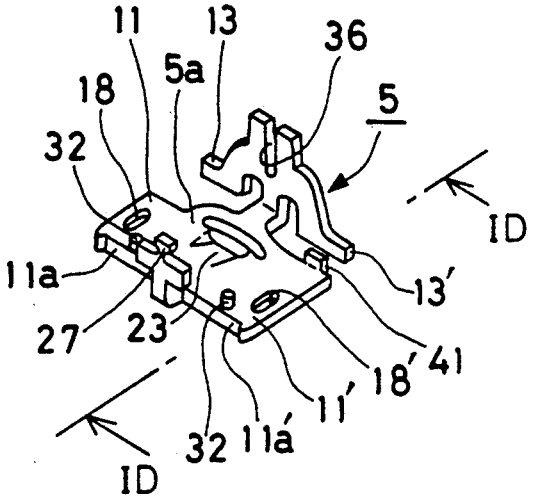
Figure 1C:
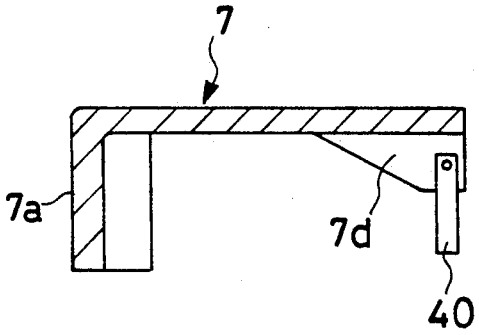
Figure 1D:
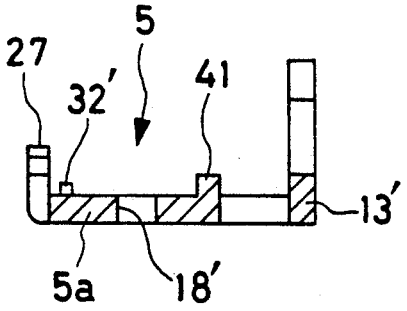
Figure 2:
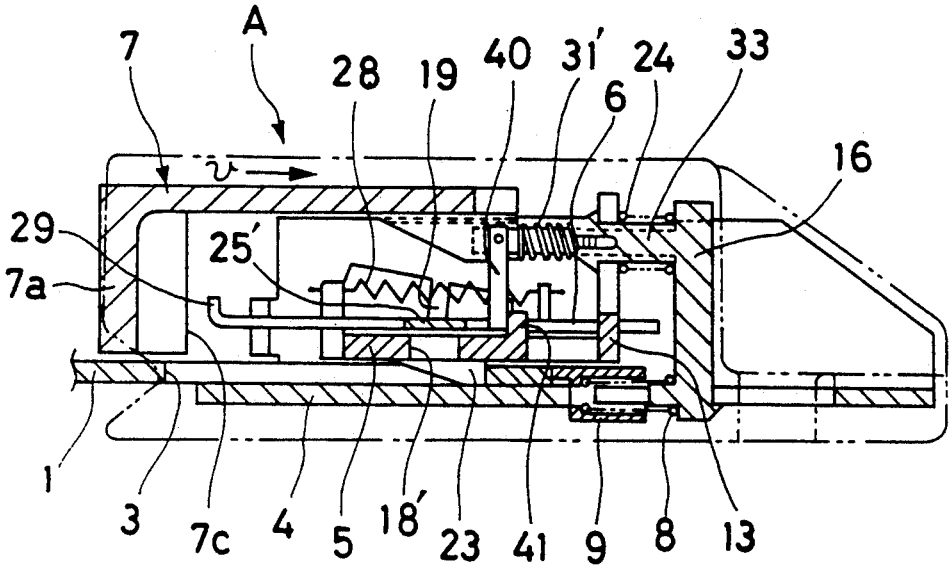
FIG. 2 is a cross-sectional view showing the connection of the tongue with buckle main body in this embodiment.
Figure 4:
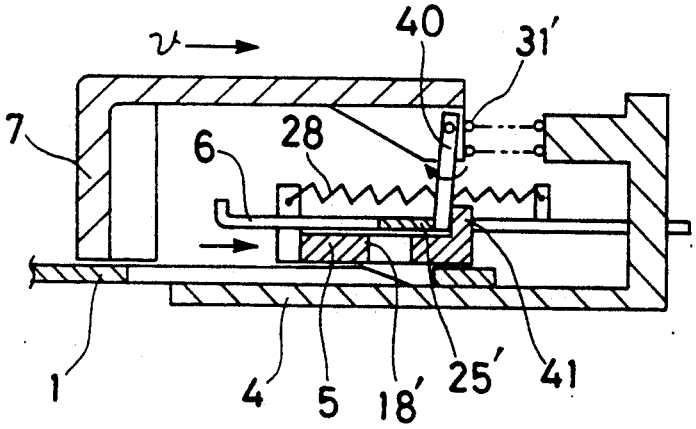
FIG. 4 illustrates the operation when an impact is applied in the direction to release the engagement in this embodiment.
Figure 5A:
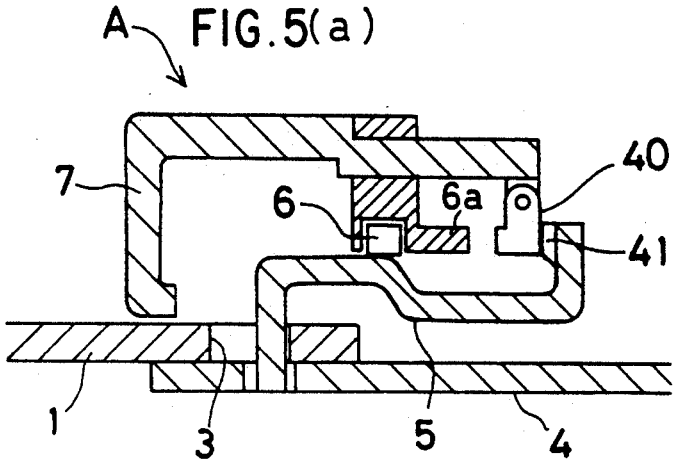
Figure 5B:
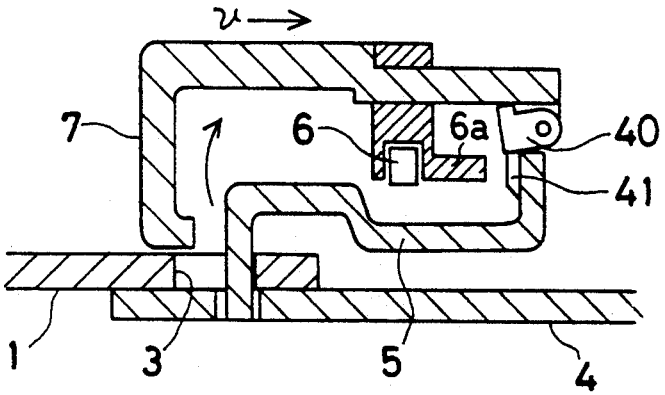
Figure 5C:
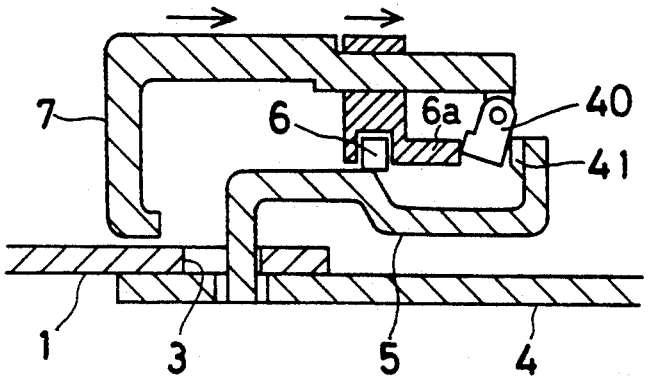
Figure 6A:
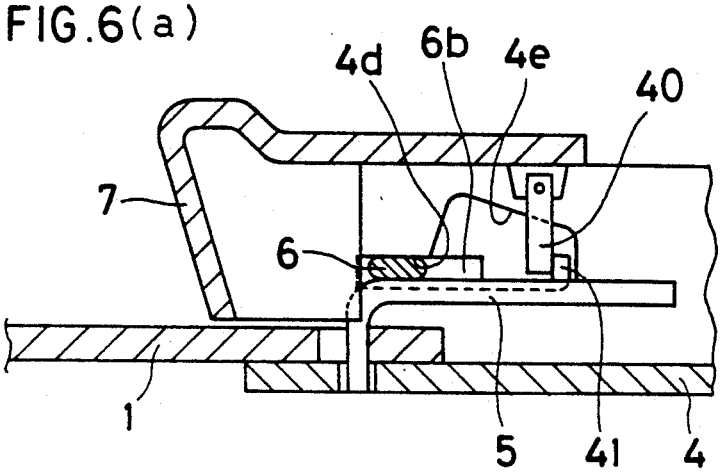
Figure 6B:
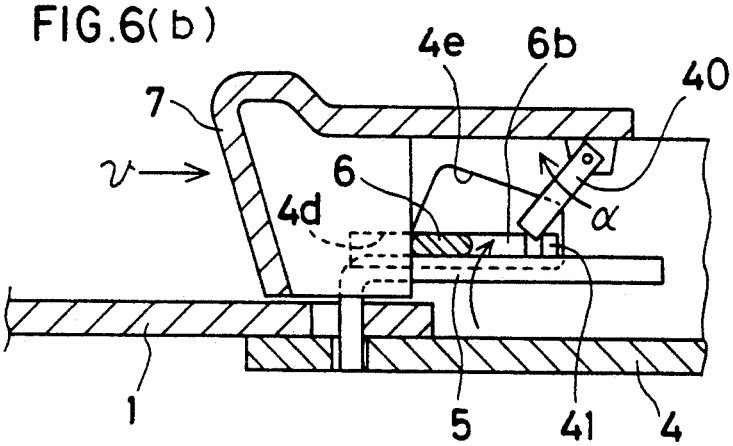
Figure 6C:
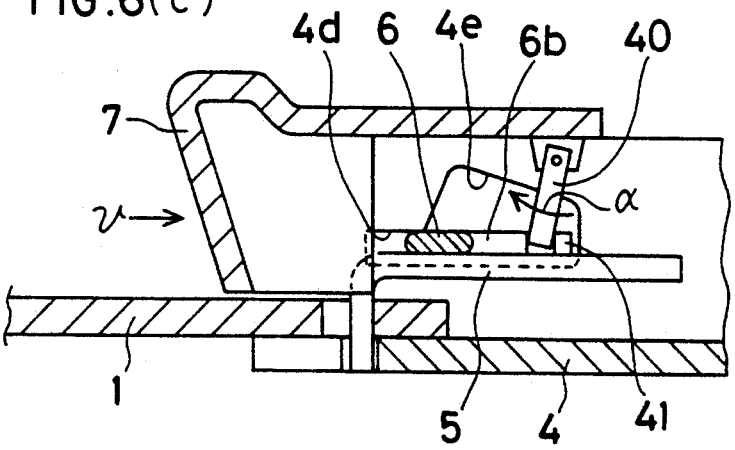
Figure 7A:
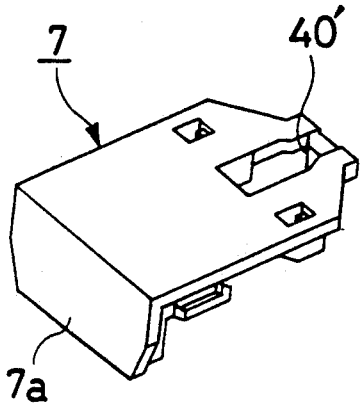
Figure 7B:
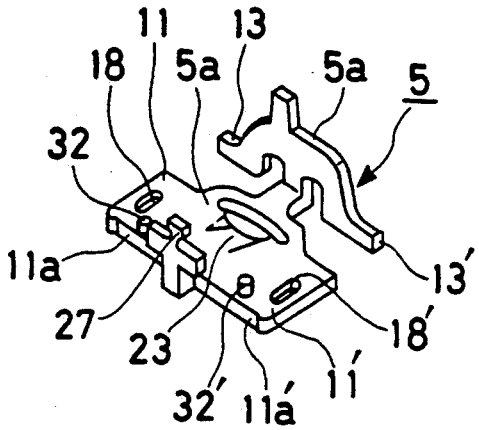
Figure 8:
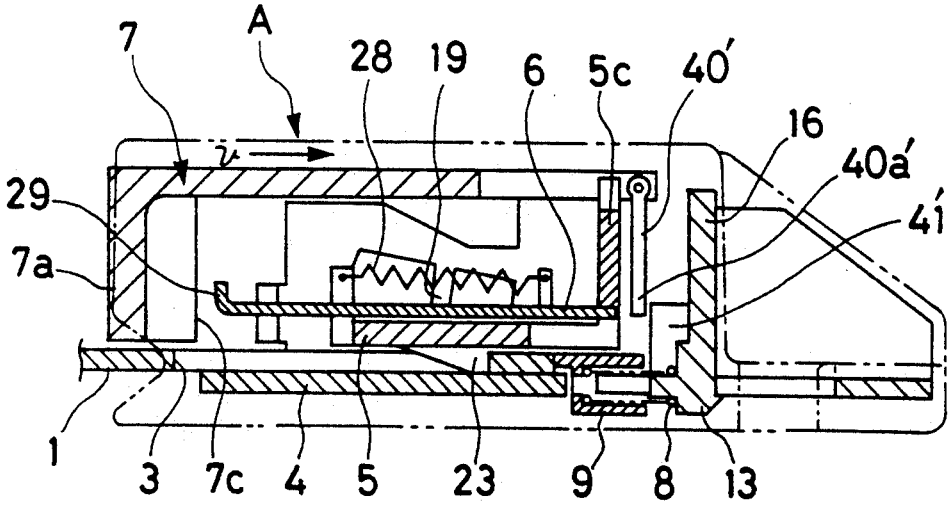
Figure 9:
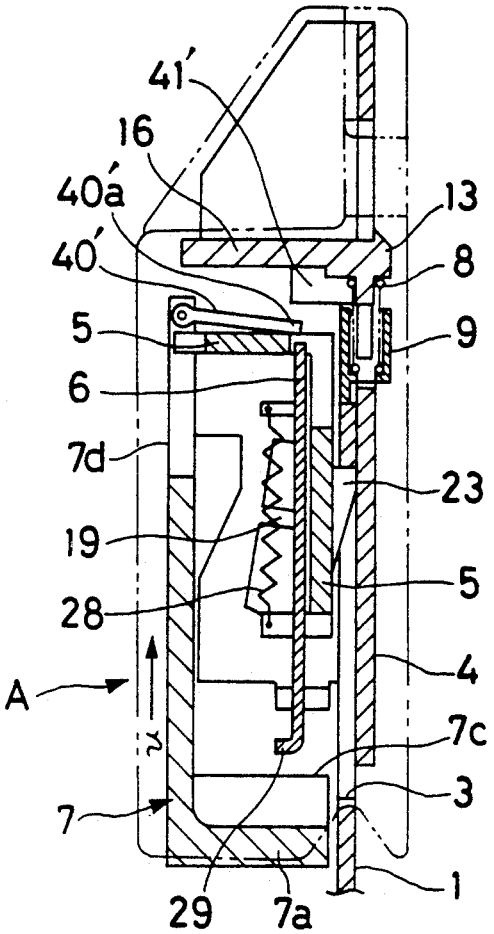
Figure 10:
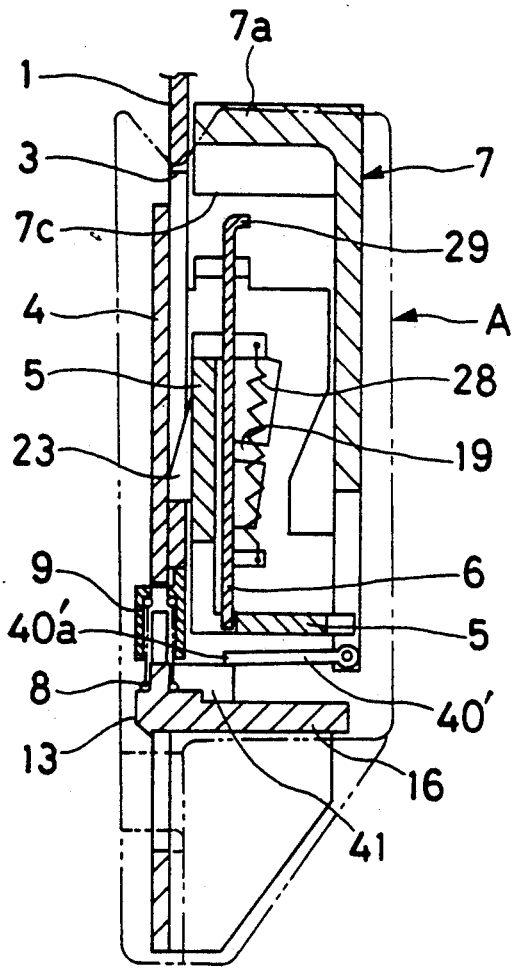
Figure 11:
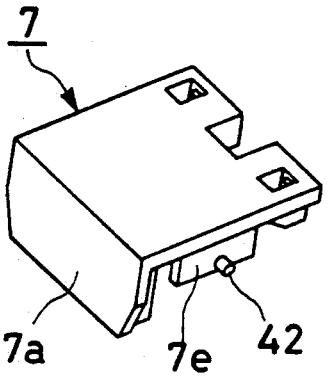
Figure 12:
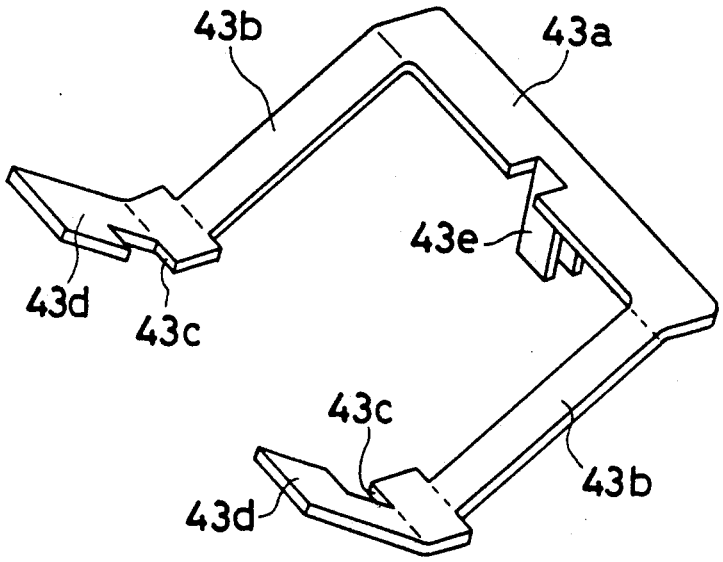
Figure 13:
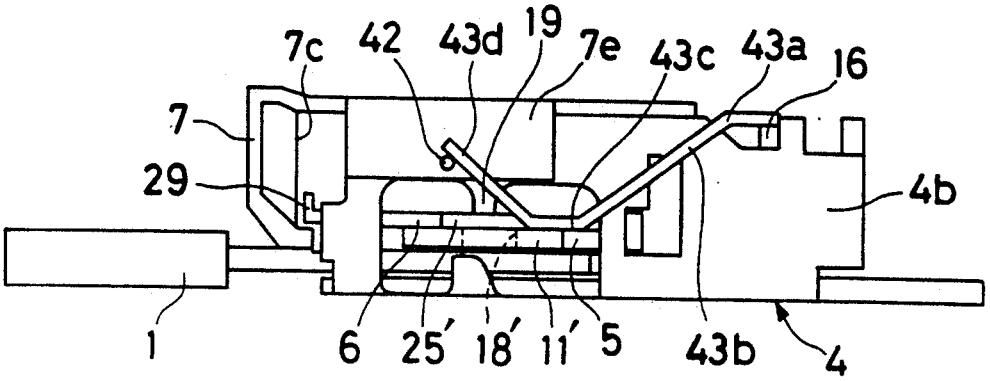
Figure 14A:
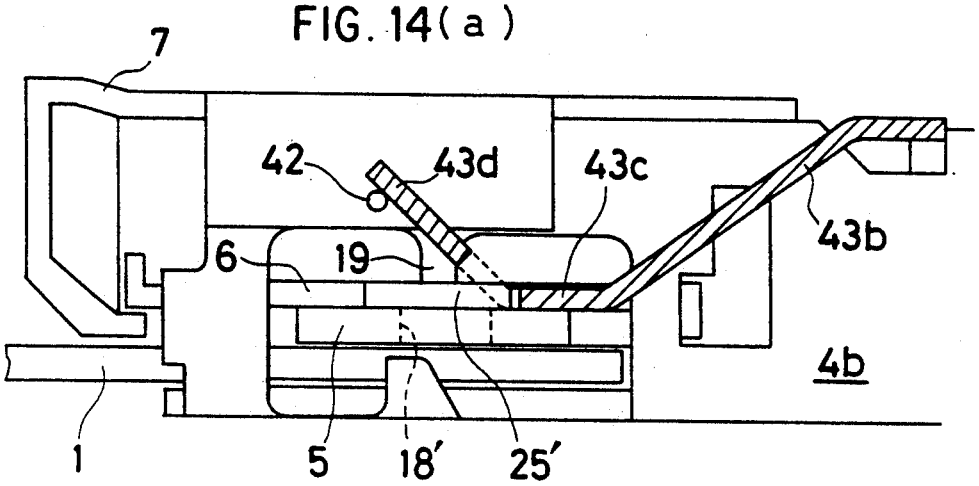
Figure 14B:
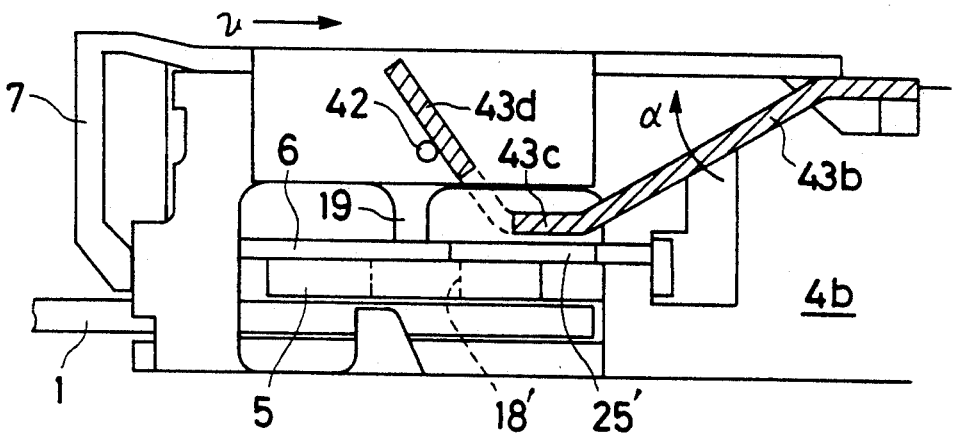
Figure 14C:
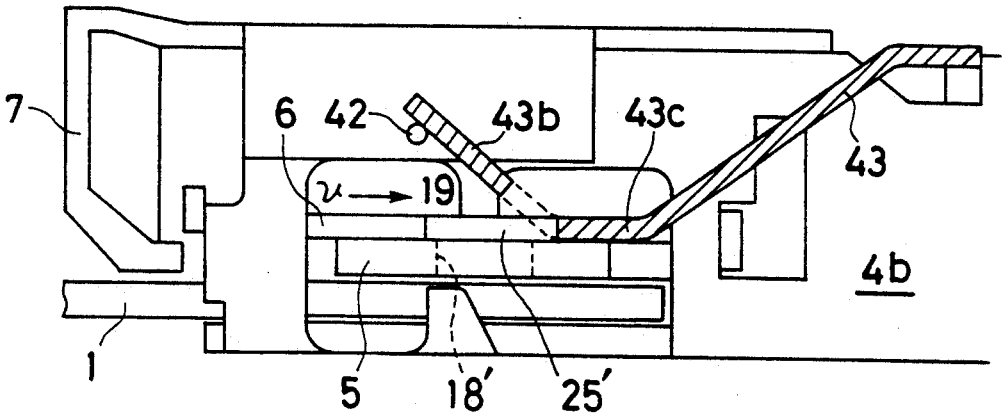
Figure 15:
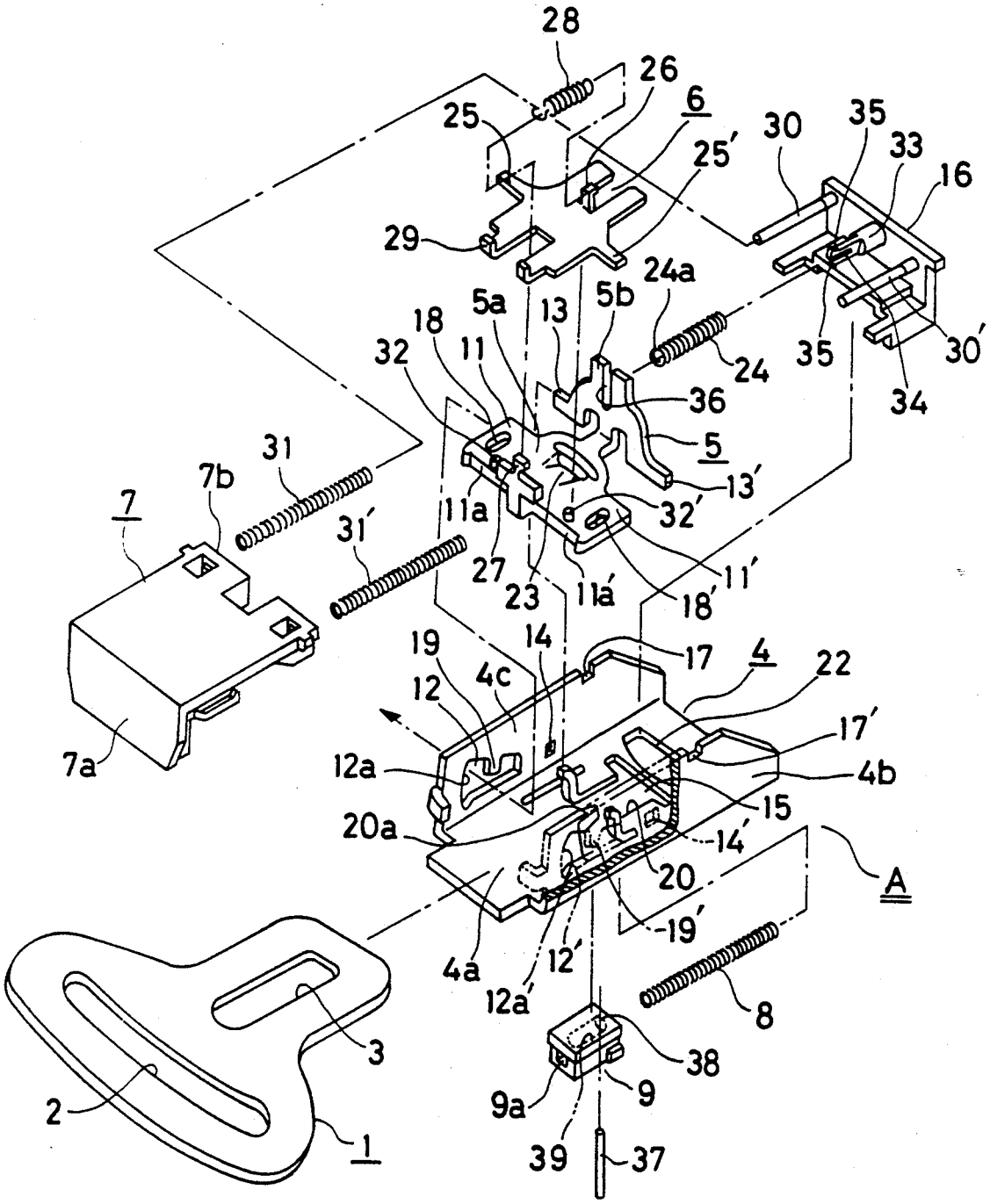
FIG. 15 PRIOR ART
Figure 16:
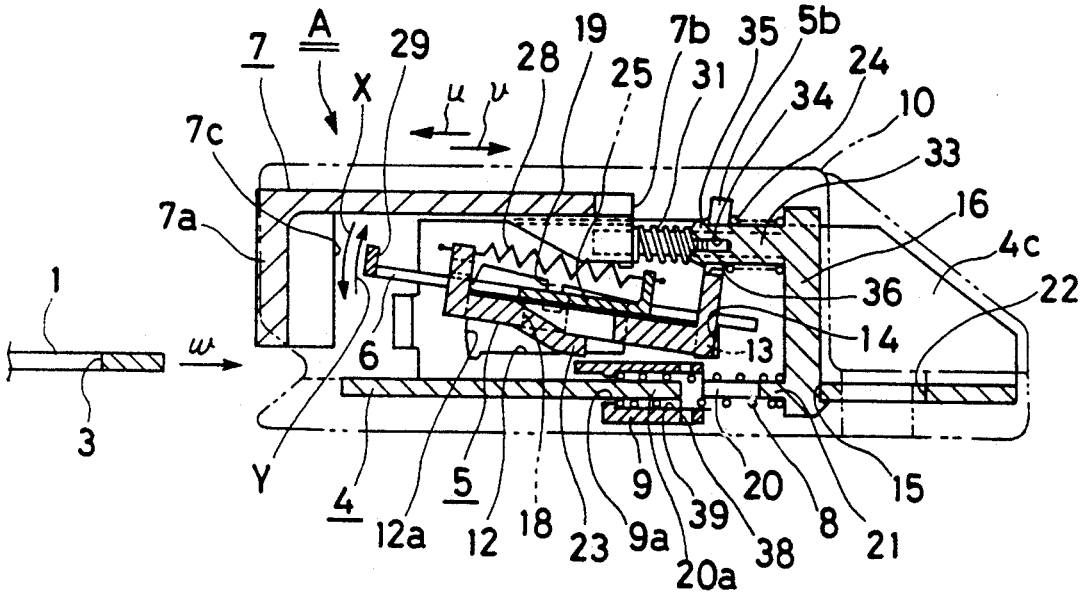
FIG. 16 PRIOR ART
Figure 17:
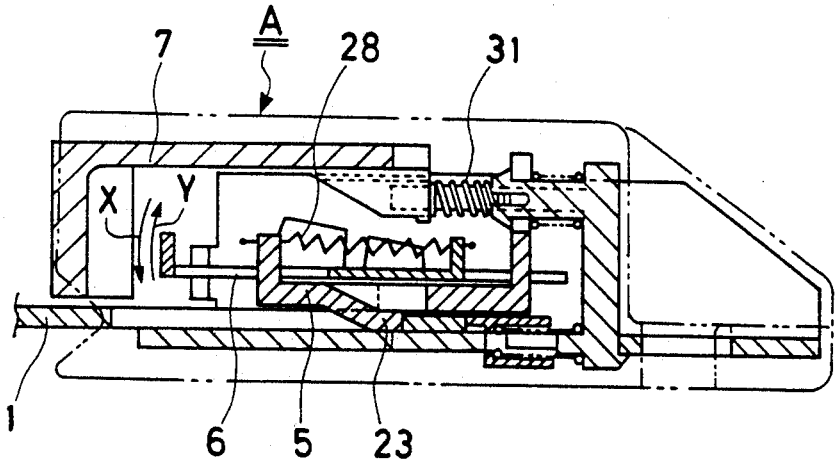
FIG. 17 PRIOR ART

FIG. 5(*a*), 5(*b*) and 5(*c*) shows another embodiment of this invention;

FIG. 6(*a*), 5(*b*) and 6(*c*) represents still another embodiment of this invention;

FIG. 7 shows a part of yet another embodiment of this invention, where (a) is a perspective view of the operating member, and (b) is a perspective view of latch member;

FIG. 8 is a cross-sectional view similar to FIG. 2, showing the connection of the tongue with buckle main body in this embodiment;

FIG. 9 illustrates the condition where the buckle main body is tilted in this embodiment;

FIG. 10 shows the conditions where the buckle main body is tilted in this embodiment;

FIG. 11 is a perspective view of the operating member showing a part of another embodiment of this invention;

FIG. 12 is a perspective view of a movement control member to be used in this embodiment;

FIG. 13 is a side view showing the connection of the tongue with the buckle main body in this embodiment;

FIG. 14 illustrates the release of the engagement by the action of the operating member in this embodiment, where (a) shows the condition before operation, (b) represents the condition during operation, and (c) the condition of the operation up to the release position;

FIG. 15 is an exploded view of an example of conventional type buckle unit;

FIG. 16 is a cross-sectional view of conventional type buckle unit before the tongue is inserted; and FIG. 17 is a cross-sectional view of conventional type buckle unit after the tongue is inserted.

DESCRIPTION OF THE PREFERRED EMBODIMENTS

Because the buckle unit of this embodiment comprises almost the same components as the one described above, detailed description is not given here on the components other than those shown in FIG. 1 and FIG. 2. Also, in FIG. 1 and FIG. 2, the same symbols are given to the same components as the above buckle unit, and detailed description is not given.

As shown in FIG. 1 (*a*) and (*c*), a movement control member 40 of the operating member 7 is movably supported on lower surface of rear end of the operating member 7 through a bracket 7*d*. On the other hand, latch member 5 is provided with a projection 41, which protrudes upward on the rear end of the extended portion 11'. As shown in FIG. 2, latch member 5, locking member 6, operating member 7, ejector 9 and spring support plate 16 are assembled on frame 4 to make up a buckle unit. When tongue 1 is inserted into this buckle unit and the claw 23 of the latch member 5 is engaged with the engagement hole 3 of the tongue 1, the tip of the movement control member 40 is located in the moving locus region of the movement stopper 25' of the locking member 6, and the rear surface of the tip of the movement control member 40 is in contact with the front surface of the projection 41 of the latch member 5. To cancel the engagement of the tongue 1 with buckle unit, the operating member 7 and the locking member 6 are moved in the direction "v" by pushing the operating member 7, and the movement control member 40 is rotated clockwise by the projection 41. Before the movement stopper 25' of the locking member 6 is brought into contact with the tip of the movement control member 40, the tip of the movement control member 40 is separated from the moving locus region of the stopper 25'.

The tension spring 28 and a pair of springs 31 and 31' are designed to have lower spring force so that the operating touch will be light. In this case, the spring forces of tension spring 28 and a pair of springs 31 and 31' are set in such manner that, when impact is applied on the buckle unit in the direction "v," the locking member 6 is moved faster than the operating member 7 by inertia and that the stopper 25' of the locking member 6 is brought into contact with the tip of the movement control member 40 before the tip of the movement control member 40 is separated from the moving locus region of the stopper 25'. Moreover, under such contacting condition, the stoppers 25 and 25' cover the open holes 18 and 18' of the extended portion almost completely so that the projections 19 and 19' do not enter into the open holes 18 and 18'.

Figure 3A:
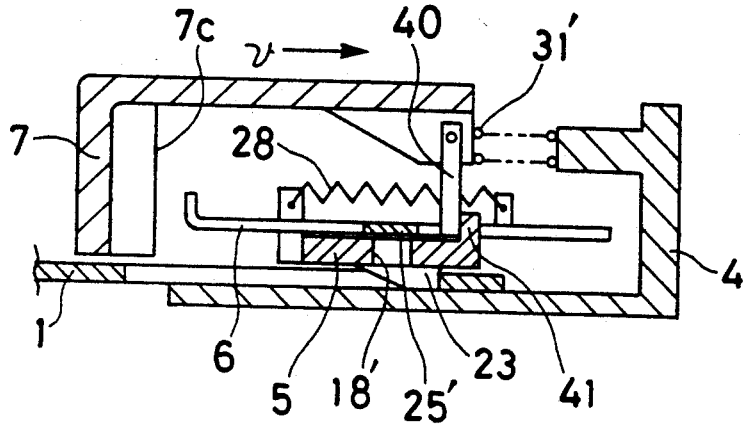
FIG. 3 illustrates the release of the engagement by the action of the operating member in this embodiment, where (a) shows the condition before operation, (b) represents the condition during operation, and (c) shows the condition where operation is performed up to the release position.
Figure 3B:
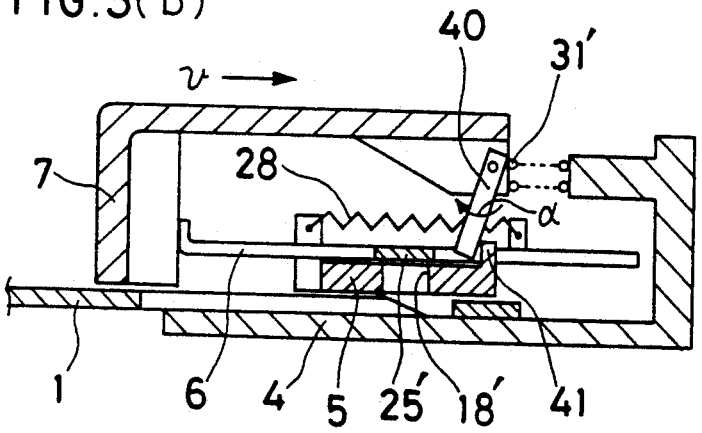
Figure 3C:
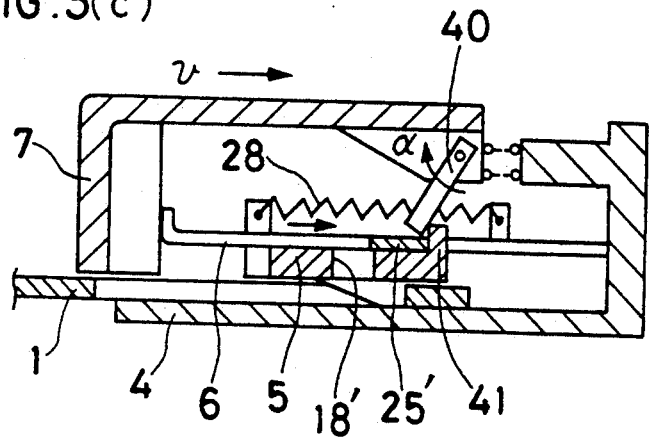

In the present embodiment with such arrangement, when normal pushing operation of the operating member 7 is performed to release the engagement from the state where the tongue 1 is inserted in and connected with the buckle main body A as given in FIG. 3 (*a*), the operating member 7 is moved toward the direction "v" as given in FIG. 3 (*b*), and the movement control member 40 is rotated in the direction of the arrow $\alpha$ by the projection 41. After the locking member touching surface 7*c* of the operating member 7 is brought into contact with the touching portion 29 of the locking member 6, if the operation member 7 is moved further in the direction "v," the locking member 6 is also moved toward the direction "v," and the movement control member 40 is further rotated toward the direction $\alpha$. Before the stopper 25' of the locking member 6 is brought into contact with the movement control member 40, the tip of the movement control member 40 is withdrawn from the moving locus region of the stopper 25', and, as shown in FIG. 3 (c), the locking member 6 is moved to such position that the open holes 18 and 18' of the extended portions 11 and 11' are opened almost completely. Therefore, the projections 19 and 19' can enter the open holes 18 and 18' as in the case of conventional type buckle unit described above. The lever touching surface 7*b* pushes the lever member 5*b* of the latch member 5, and latch member 5 is rotated in the direction of the arrow "Y" against the resilient force of compression coil spring 24. Accordingly, the claw 23 of the latch member 5 is displaced upward and the latch member is withdrawn from the engagement hole 3 of the tongue 1, and the tongue 1 is pushed by the ejector 9 and is separated from the buckle main body A.

Also, when an impact stronger than the predetermined strength is applied in the direction "v" on the buckle main body A by collision under the condition of FIG. 3 (*a*), the locking member 6 and the operating member 7 are moved in the direction "v" by the inertia of the impact. In this case, the locking member 6 is moved faster in the direction "v" than the operating member 7 because of the relationship in the spring forces of tension spring 28 and the springs 31 and 31'. The movement control member 40 is rotated slightly by the movement of the operating member 7, but the front surface of the tip of the movement control member 40 is brought into touch with the rear end of the stopper 25' while the tip of the movement control member 40 is still within the moving locus region of the stopper 25'. As the result, further movement of the locking member 6 by inertia in the direction "v" is hindered. At the position where this locking member 6 is hindered from moving, the stoppers 25 and 25' close the open holes 18 and 18' of the extended portions 11 and 11' almost completely. Therefore, the projections 19 and 19' cannot enter the open holes 18 and 18', and the latch member 5 is hindered from rotating toward the direction to cancel the engagement of the claw 23 with the tongue 1. As the result, even when such a large impact is applied on the buckle unit A, the connection of the tongue 1 with the buckle main body A is perfectly maintained. Because the connection of the tongue 1 with the buckle main body A is maintained even at the time of impact, the spring forces of the tension spring 28 and the springs 31 and 31' may be lower.

In the present embodiment, description has been given for the case where impact is applied in the direction "v," whereas it is needless to say that the connection of the tongue 1 with the buckle main body A is maintained even when the impact is applied in other direction than "v."

Although the movement control member 40 is furnished on the operating member 7 side, it is possible to provide this movement control member 40 on the side of the latch member 5 or on the other adequate part of the buckle main body A so that the movement control member 40 can be rotated by the rear end of the operating member 7. Although the projection 41 is furnished on the latch member 5, this projection may be provided at adequate position on the buckle main body A.

Further, when the tongue 1 is connected with the buckle unit A in this embodiment, the rear surface of the movement control member 40 is brought into touch with the front surface of the projection 41, whereas it is possible to adjust the operating response by providing a gap between the rear surface of the movement control member 40 and the front surface of the projection 41.

FIG. 5 is a schematical illustration of another embodiment of this invention, similar to FIG. 2. The same components as in the conventional example and the embodiment as described above are referred by the same symbols, and detailed description is not given here. The other components not shown in the buckle unit of this embodiment are the same as in the above conventional example and the embodiments, and these are not shown.

In this embodiment, as shown in FIG. 5 (*a*), the latch member 5 is hindered from moving toward the direction to release the engagement by the locking member 6 when the buckle main body A is connected with the tongue 1. As shown in FIG. 5 (*b*), the present invention is applied to the buckle unit of such type that the latch member 5 can be moved toward the direction to release the engagement by arranging the locking member 6 at the recess 5*d* of the latch member 5.

On the locking member 6, a guide unit 6*a* capable to get into touch with the movement control member 40 is formed integrally, and the lock unit is made up from the locking member 6 and the guide unit 6*a*. When this lock unit is moved toward the direction to release the operating member 7, the latch member 5 is moved to such position that the engagement with the tongue 1 can be released.

Similarly to the above embodiment, the movement control member 40 is rotatably arranged on rear end of the operating member 7, and the rear end of the latch member 5 is provided with a projection 41 to get into touch with the movement control member 40. As shown in FIG. 5 (*a*), when the latch member 5 and the tongue 1 are engaged, the tip of the movement control member 40 is located within the moving locus region of the guide unit 6*a* of the lock unit. As shown in FIG. 5 (*b*), before the lock unit comes to the position where the engagement of the latch member 5 can be released, the movement control member 40 is rotated and is withdrawn out of the moving locus region of the guide unit 6*a*. As the result, it is possible that the lock unit is moved to the position where the engagement of the latch member 5 can be released.

The tension spring (shown by the symbol 28 in the above example) to push the lock unit (not shown) and the springs (shown by the symbols 31 and 31' in the above example) to push the operating member are designed to have relatively lower spring force so that operating touch will be lighter. In this case, the spring forces of these springs are set in such manner that when impact is applied on the buckle unit in the direction to release the engagement as shown in FIG. 5 (*c*), the lock unit is moved faster than the operating member 7 by inertia and that the guide unit 6*a* gets into touch with the tip of the movement control member 40 before the tip of the movement control member 40 is withdrawn from the moving locus region of the guide unit 6*a*. When the guide unit 6*a* is in touch with the tip of the control member 40, the locking member 6 is maintained at the position to hinder the latch member 5 from moving in the direction to release.

The operation of this embodiment is the same as that of the above embodiment, and detailed description is not given here.

FIG. 6 schematically illustrates still another embodiment of this invention, similarly to FIG. 2. Description will be given only on the components different from those of the above embodiments and conventional examples.

As shown in FIG. 6, in this embodiment, the present invention is applied on a buckle unit, in which the locking member 6 is guided by the guide hole 4*d* formed on the frame 4 and is moved to the position to hold the latch member 5 at the engagement position as shown in FIG. 6 (*a*), and to the position of the recess 4*e* of the guide hole 4*d* as shown in FIG. 6 (*b*), i.e. the position where the latch member 5 can release the engagement.

The locking member 6 is pushed permanently toward the position to maintain the latch member 5 on the engagement position by a tension spring (not shown) (shown by the symbol 28 in the above example), and the latch member 5 can be moved by the operating member 7 toward the position where engagement can be released.

On this operating member 7, the movement control member 40 is also rotatably arranged and the latch member 5 is provided with a projection 41, with which the movement control member 40 comes into touch.

Also, in this embodiment, a guide unit 6*b* integrally formed with locking member 6 is placed face-to-face to the movement control member 40. During normal operation of the operating member 7, the movement control member 40 is withdrawn from the moving locus region of the guide unit 6*b*. Thus, the locking member 6 can move toward the position where the latch member 5 can release the engagement without requiring the guide unit 6*b* to get into touch with the movement control member 40. As shown in FIG. 6 (*c*), when impact is applied on the buckle unit in the direction to release the engagement, the locking member 6 is moved faster. The guide unit 6*b* gets into touch with the movement control member 40 before the moving control member 40 is withdrawn to outside the moving locus region of the guide unit 6*b*. In so doing, the locking member 6 maintains the latch member 5 at the position where the engagement of the latch member 5 with the tongue can be maintained.

FIG. 7 to FIG. 10 show still another embodiment of the invention. The same components as in the above embodiments and conventional examples are referred by the same symbols, and detailed description is omitted. Description will be given only on the different components.

As shown in FIG. 7 (*a*) and FIG. 8, movement control member 40' is movably mounted at the center on the end of the operating member 7 opposite to the pressing surface 7*a*. Normally, the movement control member 40' is arranged in such manner that its free end 40'*a* is located in the moving locus region of the locking member 6. Also, the free end 40'*a* is positioned between the upright portion 5*c* of the latch member 5 and the projection 41' on the spring support.

The movement control member 40' and the projection 41' have the same functions as those of the movement control member 40 and the projection 41 in the embodiment of FIG. 1. Therefore, the projection 41 as shown in FIG. 1 (*b*) is not furnished on the latch member 5.

Next, description is given on the operation of this embodiment with such arrangement. Because the operation of this embodiment is almost the same as that of the embodiment of FIG. 1, description is given here on the different portions only.

When big impact occurs due to collision, it appears that the buckle main body A is moved in such manner that the left side of the buckle main body A in FIG. 8 is turned downward as shown in FIG. 9. In this case, the movement control member 40' tends to rotate, but the movement control member 40' is in touch with the upright portion 5*c* and is not rotated further. When the movement control member 40' is in touch with the upright portion 5*c* in this way, the free end 40*a'* of the movement control member 40' is still within the moving locus region of the locking member 6. Therefore, when strong impact is applied on the buckle main body A in the direction "v" and the locking member 6 is moved faster by inertia, one end of the locking member 6 is brought into touch with the movement control member 40'. When one end of the locking member 6 touches, the movement control member 40' is rotated slightly and touches the projection 41' and is not rotated further. As the result, the locking member 6 is not moved further in the direction "v." In this condition, the open holes 18 and 18' of the extended portions 11 and 11' are closed almost completely by the movement stoppers 25 and 25', and this prevents the projections 19 and 19' to enter into the open holes 18 and 18'. Therefore, the latch member 5 is prevented from rotating toward the direction to release the engagement of the claw 23 with the tongue 1. As the result, even when big impact is applied on the buckle main body A at the position as shown in FIG. 9, the connection of the tongue 1 with the buckle main body A is perfectly maintained.

As shown in FIG. 10, when the buckle main body A takes such position that the right side of the buckle main body A of FIG. 8 is turned downward, the movement control member 40' tends to be rotated, but the movement control member 40' is brought into touch with the projection 41' and is not rotated further. Similarly to the embodiment of FIG. 9, even when big impact is applied on the buckle main body A, which takes the position as shown in FIG. 10, the connection of the tongue 1 with the buckle main body A is perfectly maintained.

FIG. 11 to FIG. 14 represent still another embodiment of this invention. The same components as in the above embodiments are referred by the same symbols, and description is not given here. Description will be given only on the different components.

As shown in FIG. 11, a cylindrical projections 42 are furnished on both sides of the operating member 7 through the brackets 7*e*. (In the figure, projection 42 is shown only on one side.) On the other hand, the movement control member 43 is formed in approximately U-shape as given in FIG. 12. Specifically, the arms 43*b* and 43*b* are extending with an inclination from both ends of the main body 43*a*, and these arms 43*b* and 43*b* are provided with stoppers 43*c* and 43*c*. Further, these stoppers 43*c* and 43*c* are provided with guide pieces 43*d* and 43*d*, which are inclined upward. At the center of the main body 43*a*, a mount 43*e* is furnished. The arms 43*b* of this movement control member 43 are elastic.

In the movement control member 43 with such arrangement, the mount 43*e* is fixed on the spring support plate 16 as shown in FIG. 13 with the main body 43*a* supported on upper end of the spring support plate 16. When the movement control member 43 is assembled on the support plate 16, both arms 43*b* and 43*b* are positioned outside the lateral walls 4*b* and 4*c* of the frame 4. When the tongue 1 is engaged with the buckle main body A, the stopper 43*c* is brought into touch with the extended portions 11 and 11' of the latch member 5. In this case, by resilient force of the arms 43*b*, the stopper 43*c* is pushed on the extended portions 11 and 11'. Further, the guide surface of the guide piece 43*d* touches the cylindrical projection 42 on the operating member 7. When the operating member 7 is operated in the direction "v," the projection 42 pushes the guide piece 43*d* upward, and the guide pieces 43*b*, stopper 43*c* and guide piece 43*d* are rotated toward the direction "α" around the connection of the arms 43*b* with the main body 43*a*. In this case, when the operating member 7 is operated toward the direction "v," the resilient force of the arm 43*b* and the inclination angle of the guide piece 43*d* are set to such values that no substantial resistance will not occur.

When the movement control member 43 is assembled on the support plate 16, the stopper 43*c* is positioned face-to-face to the movement stoppers 25 and 25' of the locking member 6 with a certain gap.

In the present embodiment with such arrangement, the operation is basically the same as in the above embodiments.

Giving brief description, the tongue 1 is inserted into the buckle main body A, and these are normally engaged as shown in FIG. 14 (*a*). When operating member 7 is operated in the direction "v" to release the engagement of the tongue 1 with buckle main body A, the projection 42 pushes the guide piece 43*d* upward. The stopper 43*c* is moved upward, and the stopper 43*c* is withdrawn from the moving locus region of the movement stoppers 25 and 25' before the movement stoppers 25 and 25' are brought into touch with the stopper 43*c*. For this reason, the locking member 6 can be moved toward the position where the open holes 18 and 18' of the extended portions 11 and 11' can be opened almost completely. Thus, the projections 19 and 19' can enter into the open holes 18 and 18', and the tongue 1 can be separated from the buckle main body A as in the cases of the above embodiments.

The operating force of the operating member 7 is relatively low because the inclination angle of the guide piece 43*d* and the resilient force of the arm 43*b* are set in such manner that no substantially big resistance occurs. This results in light operating touch.

When the impact bigger than expected is applied on the buckle main body A in the direction "v" due to collision under the condition of FIG. 14 (*a*), the locking member 6 is moved faster than the operating member 7 as in the cases of the above embodiments. As shown in FIG. 14 (*c*), the movement stopper 25' is brought into touch with the stopper 43*c* while the stopper 43*c* is still within the moving locus region of the movement stoppers 25 and 25'. For this reason, the movement of the locking member 6 is hindered, and the movement stoppers 25 and 25' maintain the open holes of 18 and 18' of the extended portions 11 and 11' in almost completely closed state. Therefore, the projections 19 and 19' cannot enter into the open holes 18 and 18'. Even when big impact is applied on the buckle unit A, the connection of the tongue 1 with the buckle main body A is perfectly maintained. In this embodiment, the stopper 43*c* is perfectly maintained at the engagement position with the movement stoppers 25 and 25' by the resilient force. Thus, the release of the connection of the tongue 1 with the buckle main body A can be perfectly hindered when impact is applied, whatever the position of the buckle main body A may be.

In this embodiment, the arm 43*b*, the stopper 43*c* and the guide piece 43*d* of the movement control member 43 are furnished in pairs outside the lateral walls 4*b* and 4*c* of the buckle main body A, whereas the arm 43*b*, the stopper 43*c* and the guide piece 43*d* may be furnished in single set or in several sets inside the lateral walls 4*b* and 4*c* of the buckle main body A. In such case, the projection 42 on the operating member 7 may also be furnished in adequate number of sets.

As it is evident from the above description, it is possible according to the present invention that the locking member can be moved to the position where the engagement of the tongue with the latch member can be released during normal operation of the operating member. When impact is applied on the buckle unit, the locking member is hindered from moving toward the position where the engagement of the tongue with the latch member can be released. Accordingly, it is possible to perfectly release the connection of the buckle unit in normal operation, and to perfectly hinder the release of connection of the buckle unit when impact is applied.

Because the release of the connection of the buckle unit can be hindered when impact is applied, the resilient force to push the operating member of the locking member can be relatively weakened. This leads to light operating touch, good operation feeling and higher maneuverability of the buckle unit. Moreover, because relatively weak resilient force will suffice, the cost of the pushing means can be reduced.

What we claim is:

1. A buckle unit, comprising:

a buckle main body;

a tongue which is insertable into and engageable with the buckle main body;

a latch member for engaging with said tongue and for connecting said tongue with said buckle main body when the tongue is inserted into said buckle main body, said latch member being movable between an engaged position and a disengaged position;

an operating member movably connected to the buckle main body for releasing engagement of said tongue with said latch member;

a locking member which is movable between a first position and a second position, such that in said first position said locking member holds said latch member at said engaged position and is movable by said operating member to said second position in which engagement of said latch member with said tongue can be released; and control means for moving said locking member to said disengaged position in which engagement of said latch member with said tongue can be released when said operating member is normally manually operated, and for preventing movement of said locking member to a position where engagement of said latch member with said tongue can be released when an impact force is applied;

wherein said control means comprises an operating member biasing means for urging said operating member in a direction opposite to a release direction, a locking member biasing means for urging said locking member in a direction to hold said latch member at said engagement position, and a movement control member connected to one of said operating member and said buckle main body, a part of said movement control member being located within a moving locus region of said locking member at a position where said locking member can release the engagement of said latch member with said tongue, said movement control member being withdrawn from said moving locus region when said operating member is moved in a direction to release the engagement of said latch member with said tongue, whereby resilient forces exerted by said operating member biasing means and said locking member biasing means are set to such values that said locking member is moved faster than said operating member at a time of impact.

2. A buckle unit, comprising:

a buckle main body;

a tongue which is insertable into and engageable with the buckle main body;

a latch member for engaging with said tongue and for connecting said tongue with said buckle main body when the tongue is inserted into said buckle main body, said latch member being movable between an engaged position and a disengaged position;

an operating member movably connected to the buckle main body for releasing engagement of said tongue with said latch member;

a locking member which is movable between a first position and a second position, such that in said first position said locking member holding said latch member at said engaged position and being movable by said operating member to said second position in which engagement of said latch member with said tongue can be released; and control means for moving said locking member to said disengaged position in which engagement of said latch member with said tongue can be released when said operating member is normally manually operated, and for preventing movement of said locking member to a position where engagement of said latch member with said tongue can be released when an impact force is applied; said control means comprising an operating member biasing means for urging said operating member in a direction opposite to a release direction, a locking member biasing means for urging said locking member in a direction to hold said latch member at said engagement position, and a movement control member connected to one of said operating member and said buckle main body, a part of said movement control member being located within a moving locus region of said locking member at a position where said locking member can release the engagement of said latch member with said tongue, said movement control member being withdrawn from said moving locus region when said operating member is moved in a direction to release the engagement of said latch member with said tongue, whereby resilient forces exerted by said operating member biasing means and said locking member biasing means are set to such values that said locking member is moved faster than said operating member at a time of impact;

wherein said movement control member is movably mounted on said operating member, and said buckle main body includes means for withdrawing said movement control member from said moving locus region when said operating member is moved toward the direction to release the engagement of said tongue with said latch member.

3. A buckle unit, comprising:

a buckle main body;

a tongue which is insertable into and engageable with the buckle main body;

a latch member for engaging with said tongue and for connecting said tongue with said buckle main body when the tongue is inserted into said buckle main body, said latch member being movable between an engaged position and a disengaged position;

an operating member movably connected to the buckle main body for releasing engagement of said tongue with said latch member;

a locking member which is movable between a first position and a second position, in said first position said locking member holding said latch member at said engaged position, and said locking member being movable by said operating member to said second position in which engagement of said latch member with said tongue can be released; and control means for moving said locking member to said disengaged position in which engagement of said latch member with said tongue can be released when said operating member is normally manually operated, and for preventing movement of said locking member to a position where engagement of said latch member with said tongue can be released when an impact force is applied; said control means comprising an operating member biasing means for urging said operating member in a direction opposite to a release direction, a locking member biasing means for urging said locking member in a direction to hold said latch member at said engagement position, and a movement control member connected to one of said operating member and said buckle main body, a part of said movement control member being located within a moving locus region of said locking member at a position where said locking member can release the engagement of said latch member with said tongue, said movement control member being withdrawn from said moving locus region when said operating member is moved in a direction to release the engagement of said latch member with said tongue, whereby resilient forces exerted by said operating member biasing means and said locking member biasing means are set to such values that said locking member is moved faster than said operating member at a time of impact;

wherein said movement control member is elastically and displaceably mounted on said buckle main body, a stopper portion of said locking member being located within said moving locus region when said tongue is connected with said buckle main body, and said movement control member comprises an arm for urging said stopper into said moving locus region and a guide piece for withdrawing said stopper portion of said locking member from said moving locus region when said operating member is moved toward a direction to release engagement of said tongue with said latch member.

* * * * *